US007318487B2

(12) United States Patent
Liao

(10) Patent No.: US 7,318,487 B2
(45) Date of Patent: Jan. 15, 2008

(54) PNEUMATIC TOOL WITH AN ADJUSTABLE CLIP

(75) Inventor: Sung-Nan Liao, Ta Li (TW)

(73) Assignee: Besco Pneumatic Corp., Dali, Taichung Hsien (TW)

( * ) Notice: Subject to any disclaimer, the term of this patent is extended or adjusted under 35 U.S.C. 154(b) by 246 days.

(21) Appl. No.: 11/269,207

(22) Filed: Nov. 7, 2005

(65) Prior Publication Data

US 2007/0102176 A1 May 10, 2007

(51) Int. Cl.
*A45F 5/00* (2006.01)

(52) U.S. Cl. ..... 173/170; 173/168; 16/436; 224/269

(58) Field of Classification Search ..... 173/170, 173/162.2, 171, 168, 169; 227/130, 156; 30/298.4; 224/268, 269, 584, 930; 16/436, 16/426, 110.1
See application file for complete search history.

(56) References Cited

U.S. PATENT DOCUMENTS 3,076,627 A * 2/1963 Huron ..... 248/309.1
3,780,950 A * 12/1973 Brennan ..... 239/306
4,406,064 A * 9/1983 Goss ..... 30/298.4
5,180,019 A * 1/1993 Thiry et al. ..... 173/168
5,676,285 A * 10/1997 Vinarsky ..... 224/148.1
6,010,103 A * 1/2000 Ashworth ..... 248/301
6,230,367 B1 * 5/2001 Riedl ..... 16/436
6,352,235 B2 * 3/2002 Cizek ..... 248/692
6,565,743 B1 * 5/2003 Poirier et al. ..... 210/85
6,641,011 B1 * 11/2003 Kahn ..... 224/269
6,679,406 B2 * 1/2004 Sakai et al. ..... 224/269

* cited by examiner

*Primary Examiner*—Scott A. Smith
(74) *Attorney, Agent, or Firm*—patenttm.us; James H. Walters

(57) ABSTRACT

A pneumatic tool has a body, a handle, a clip, a biasing member and a cap. The handle is formed on and extends from the body and has a free end and an annular shank extending from the free end. The clip is rotatably and slidably mounted on the shank and has a collar and a clip tab. The collar is rotatably and slidably mounted around the annular shank and has multiple teeth formed on a side of the collar facing away from the body. The clip tab extends from the collar. The biasing member is mounted around the annular shank and has two ends abutting respectively with the handle and the collar. The cap is detachably attached to the shank and has multiple recesses respectively corresponding to and engaging with the teeth on the collar.

4 Claims, 7 Drawing Sheets

PNEUMATIC TOOL WITH AN ADJUSTABLE CLIP

BACKGROUND OF THE INVENTION

1. Field of the Invention

The present invention relates to a pneumatic tool, and more particularly to a pneumatic tool with a clip, wherein the position of the clip on the tool can be adjusted.

2. Description of the Related Art

Pneumatic tools, such as nail guns or air ratchet wrenches, are usually used in many fields. However, a conventional pneumatic tool must be contained in a tool case to allow a user to carry the pneumatic tool to a desired work location. Therefore, a tool case is necessary to carry the pneumatic tool, and this is inconvenient for the user. To solve the inconvenient carrying problem of a conventional pneumatic tool, a clip is mounted on the tool to allow a user to hang the pneumatic tool on a waist belt to conveniently carry the tool. With reference to FIGS. 6 and 7, a conventional pneumatic tool with a clip (34) substantially comprises a body (30), a handle (32), a cap (36), a clip (34) and a positioning device (38). The handle (32) is formed on and extends from the body (30) and has a free end. The cap (36) is securely attached to the free end of the handle (32) with bolts. The clip (34) is rotatably mounted around the cap (36) and comprises a collar (342) and a clip tab (344). The collar (342) is rotatably mounted around the cap (36), and the clip tab (344) extends from the collar (342). The cap (36) further has a flange abutting with the collar (342) to keep the clip (34) from escaping from the handle (32). The positioning device is mounted between the cap (36) and the clip (34) to hold the clip (34) at a position relative to the handle (32). The positioning device (38) comprises multiple recesses (362), a positioning stub (382) and a spring (384). The recesses (362) are longitudinally defined in the outer periphery of the cap (36). The positioning stub (382) is slidably held in and partially extends from the collar (342) of the clip (34) and selectively engages with one of the recesses (362) in the cap (36). The spring (384) is held inside the clip (34) to provide a biasing force to the positioning stub (382). With the engagement between the positioning stub (382) and one of the recesses (362) in the cap (38), the clip tab (344) can be held at a desired position relative to the handle (32). Accordingly, the user can hang the pneumatic tool on his/her waist belt with the clip (34).

However, when the pneumatic tool bumps with another object while a user is carrying the pneumatic tool, the external bumping force can easily rotate the body (30) or the handle (32) and the positioning stub (382) may be disengaged from the corresponding recess (362) as the body (30) or handle (32) rotates. Consequently, the clip (34) will rotate relative to the handle (32), and the position of the clip tab (344) relative to the handle (32) is unintentionally changed.

To overcome the shortcomings, the present invention tends to provide a pneumatic tool to mitigate or obviate the aforementioned problems.

SUMMARY OF THE INVENTION

The main objective of the invention is to provide a pneumatic tool with a clip, wherein the position of the clip on the tool can be adjusted, but cannot be unintentionally changed even when an external force is applied to the pneumatic tool. The pneumatic tool has a body, a handle, a clip, a biasing member and a cap. The handle is formed on and extends from the body and has a free end and an annular shank extending from the free end. The clip is rotatably and slidably mounted on the shank and has a collar and a clip tab. The collar is rotatably and slidably mounted around the annular shank and has multiple teeth formed on a side of the collar facing away from the body. The clip tab extends from the collar. The biasing member is mounted around the annular shank and has two ends abutting respectively with the handle and the collar. The cap is detachably attached to the shank and has multiple recesses respectively corresponding to and engaging with the teeth on the collar.

Other objectives, advantages and novel features of the invention will become more apparent from the following detailed description when taken in conjunction with the accompanying drawings.

DETAILED DESCRIPTION OF PREFERRED EMBODIMENT

Figure 1:
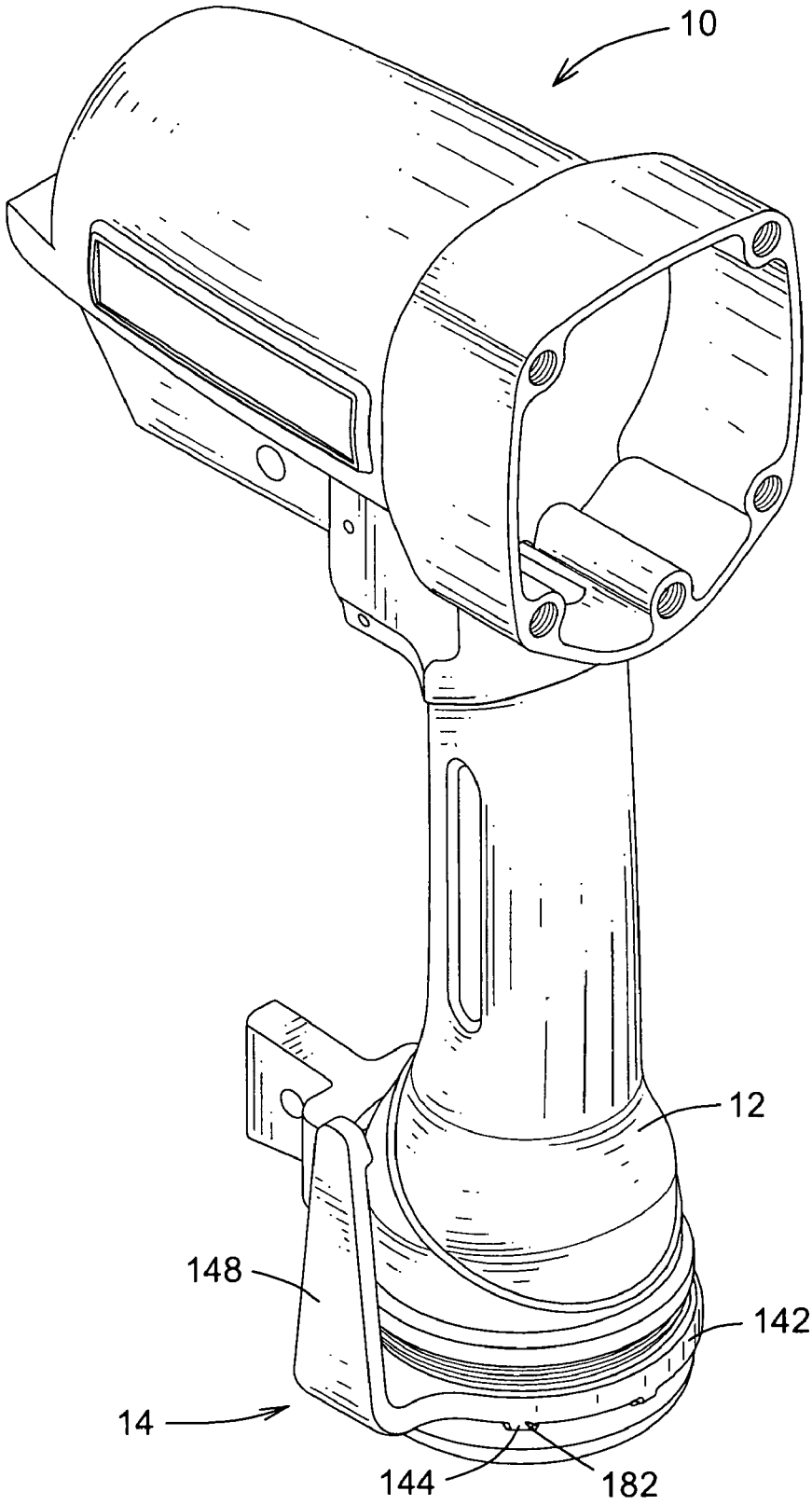
FIG. 1 is a perspective view of a pneumatic tool in accordance with the present invention.
Figure 2:
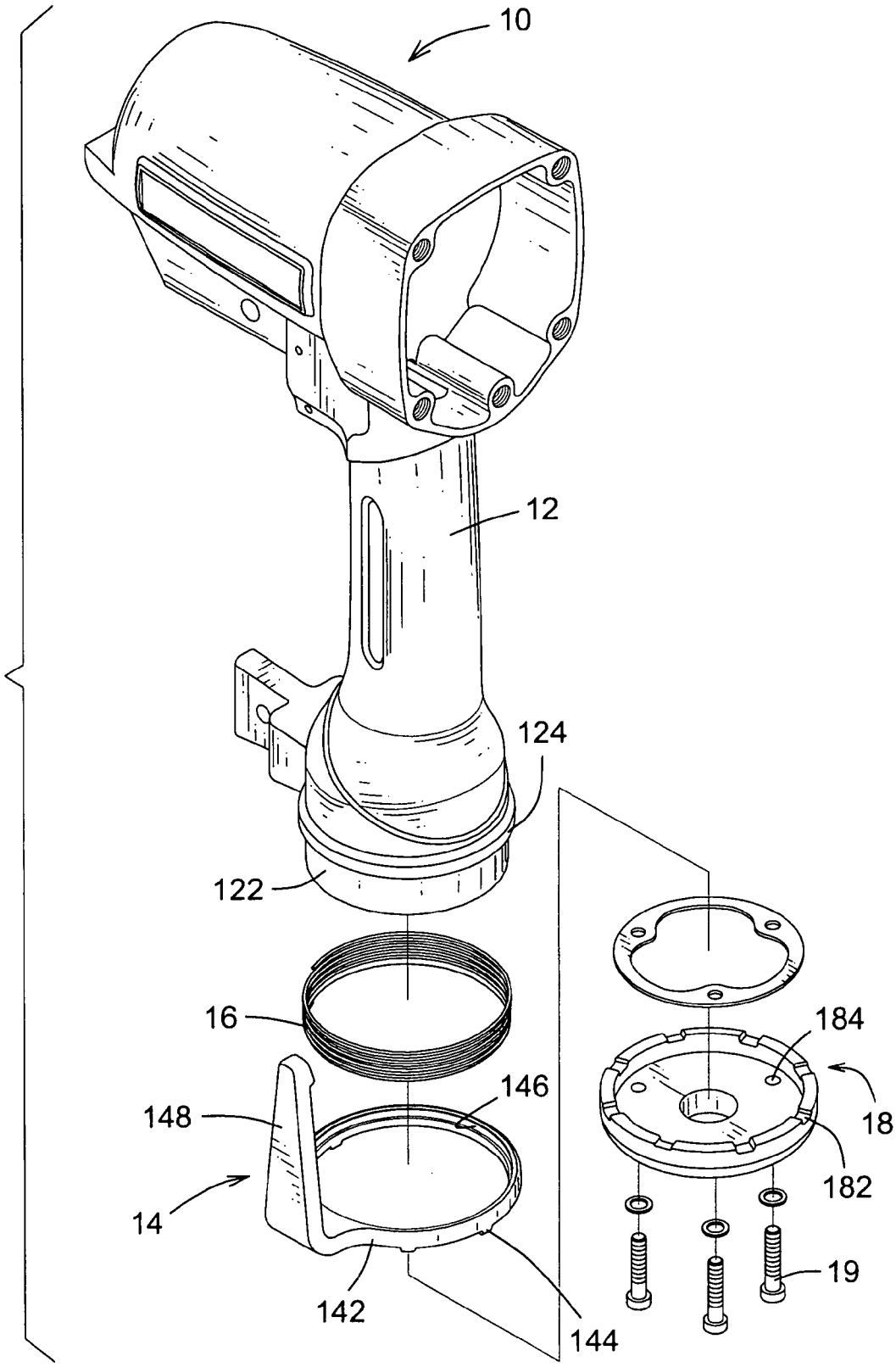
FIG. 2 is an exploded perspective view of the pneumatic tool in FIG. 1.
Figure 3:
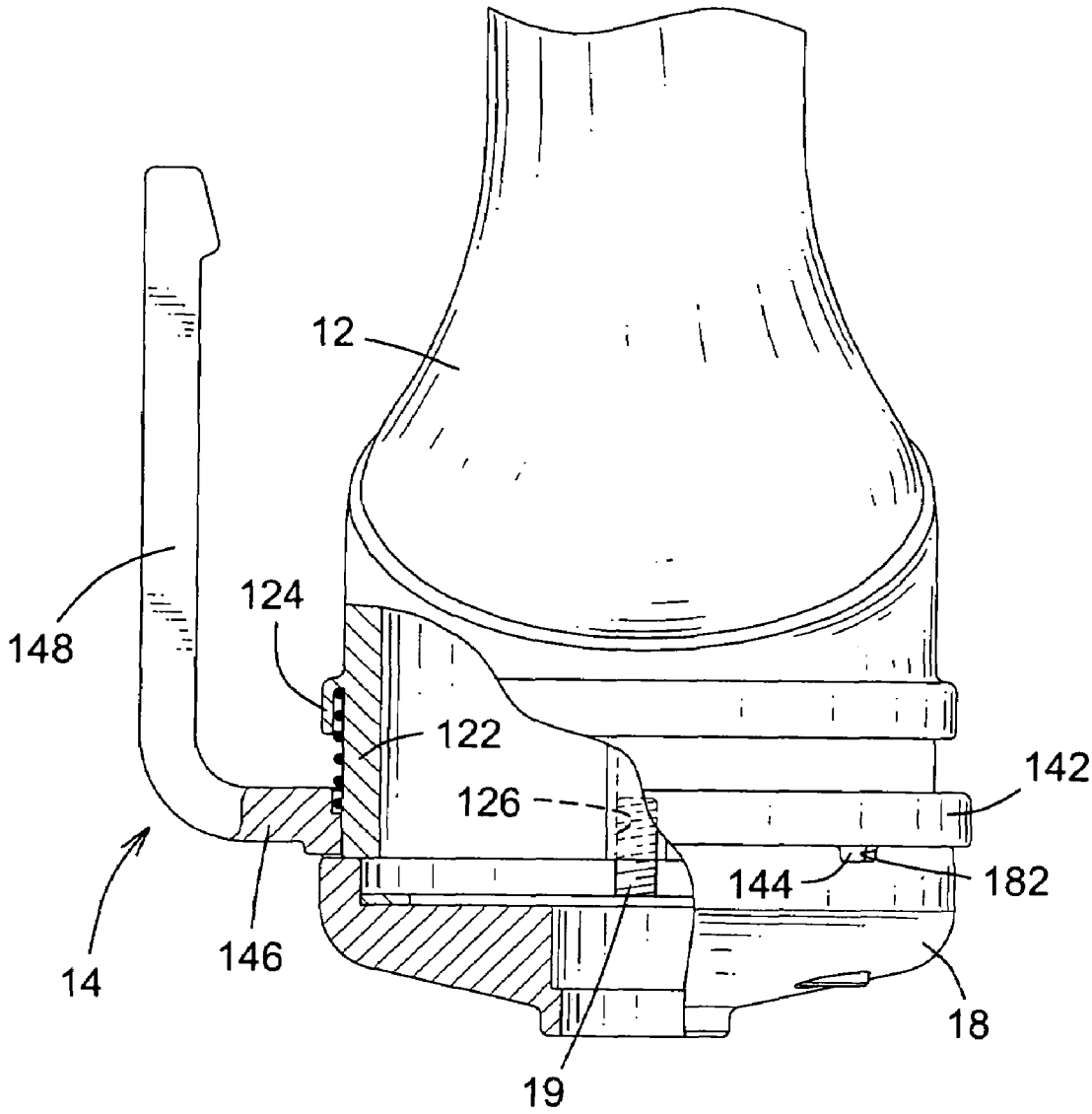
FIG. 3 is a side view in partial section of the pneumatic tool in FIG. 1.

With reference to FIGS. 1 to 3, a pneumatic tool in accordance with the present invention comprises a body (10), a handle (12), a clip (14), a biasing member (16) and a cap (18). The body (10) is hollow and has an internal mechanism contained in the body (10) and actuated by pressurized air to drive a tool. The body (10) with the internal mechanism may be a conventional one, and the detailed structure of the body (10) with the internal mechanism is omitted.

The handle (12) is formed on and extends from the body (10) to allow a user to grip the handle (10) when using the pneumatic tool. The handle (12) has a free end and an annular shank (122) extending from the free end.

The clip (14) is rotatably and slidably mounted on the shank (122) and comprises a collar (142) and a clip tab (148). The collar (142) is rotatably and slidably mounted around the annular shank (122) and has multiple teeth (144) formed on a side of the collar (142) facing away from the body (10). The clip tab (148) extends from the collar (142) toward the handle (12).

The biasing member (16) may be a spring, is mounted around the annular shank (122) and has two ends abutting respectively with the handle (12) and the collar (142). In a preferred embodiment, a skirt (124) is formed around the free end of the handle (12) and has an annular opening facing the collar (142). The collar (142) has an annular spring recess (146) defined in a side facing the handle (12). Two ends of the biasing member (16) are held respectively inside the skirt (124) and the spring recess (146) to abut respectively with the handle (12) and the collar (142).

The cap (18) is detachably attached to the shank (122) to keep the clip (14) from escaping from the shank (122). To securely attach the cap (18) to the shank (122) of the handle (12), multiple through holes (184) are defined through the cap (18), and multiple threaded holes (126) are defined in the shank (122), aligning respectively with the through holes (184) in the cap (18). Multiple bolts (19) extend through the through holes (184) in the cap (18) and screw into the threaded holes (126) in the shank (122), respectively, such that the cap (18) is detachably secured to the shank (122). In an alternative embodiment, an external thread is formed on the shank (122), and an inner thread is defined in the cap (18) to engage with the external thread on the shank (122). With the engagement of the threads, the cap (18) is detachably secured to the shank (122).

The cap (18) has multiple recesses (182) respectively corresponding to and engaging with the teeth (144) on the collar (142). With the engagement between the teeth (144) on the collar (142) and the recesses (182) in the cap (18), the clip (14) will be kept from rotating relative to the handle (12) and will be held at a desired position relative to the handle (12).

Accordingly, a user can hang the pneumatic tool on his/her waist belt with the clip (14) to conveniently carry the pneumatic tool to any desired work location. Because the clip (14) is held at a desired position by the engagement of the teeth (144) on the collar (142) and the recesses (182) in the cap (18), the clip (14) will not unintentionally rotate relative to the handle (12) even when an external force is applied to the body (10) or the handle (12). Therefore, the position of the clip (14) is held until the user adjusts the position.

Figure 4:
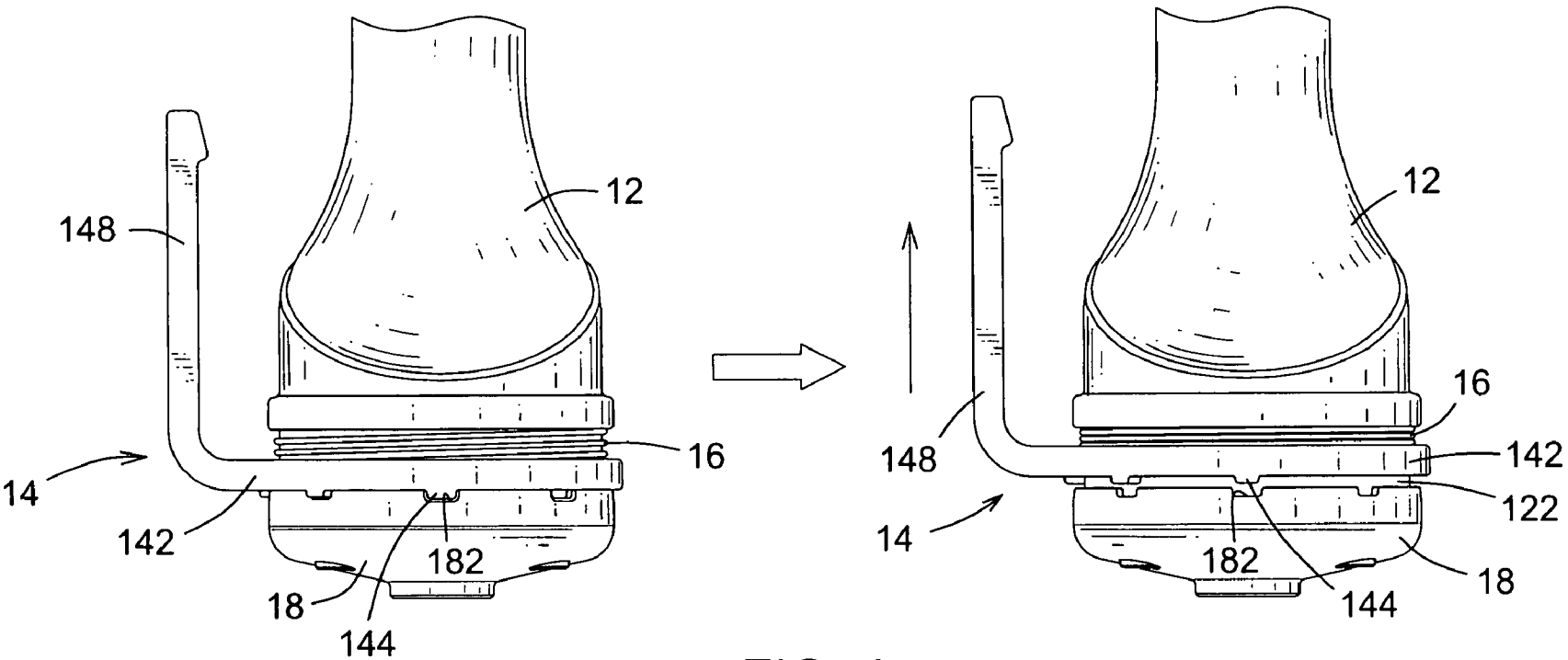
FIG. 4 is an operational side view of the pneumatic tool in FIG. 1 showing the teeth on the collar of the clip disengage from the recesses in the cap.
Figure 5:
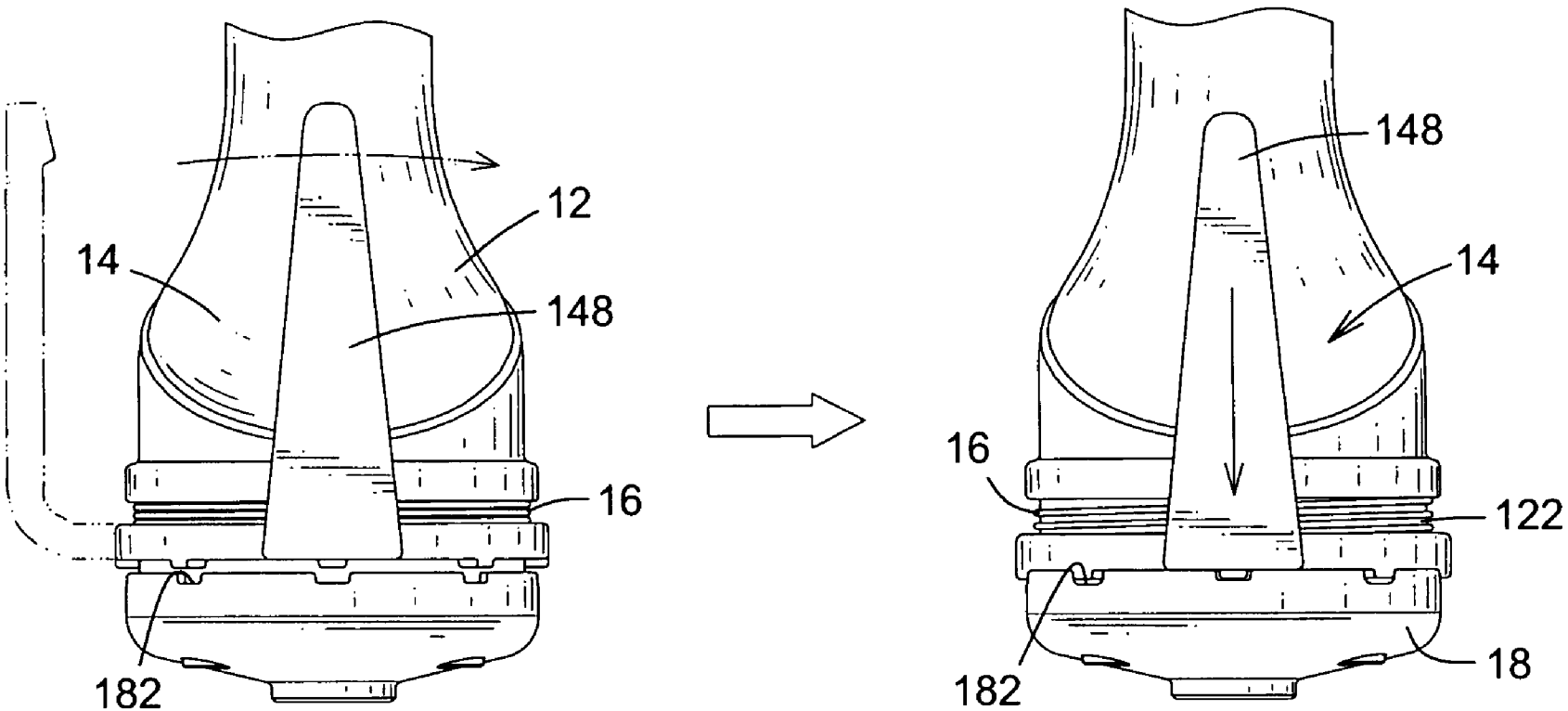
FIG. 5 is an operational side view of the pneumatic tool in FIG. 1 showing the clip rotated relative to the handle to change the position of the clip.
Figure 6:
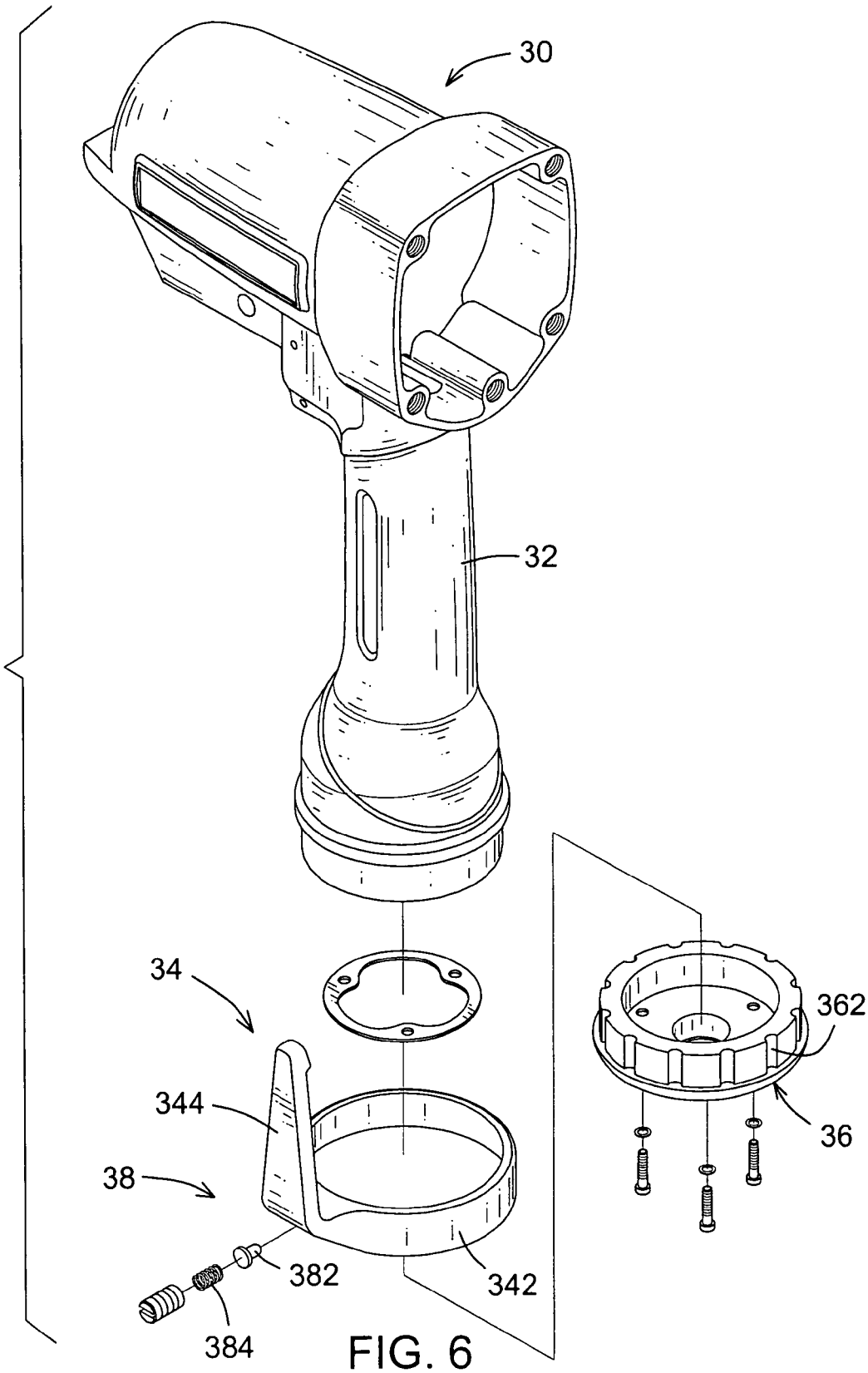
FIG. 6 PRIOR ART
FIG. 6 is an exploded perspective view of a conventional pneumatic tool in accordance with the prior art.
Figure 7:
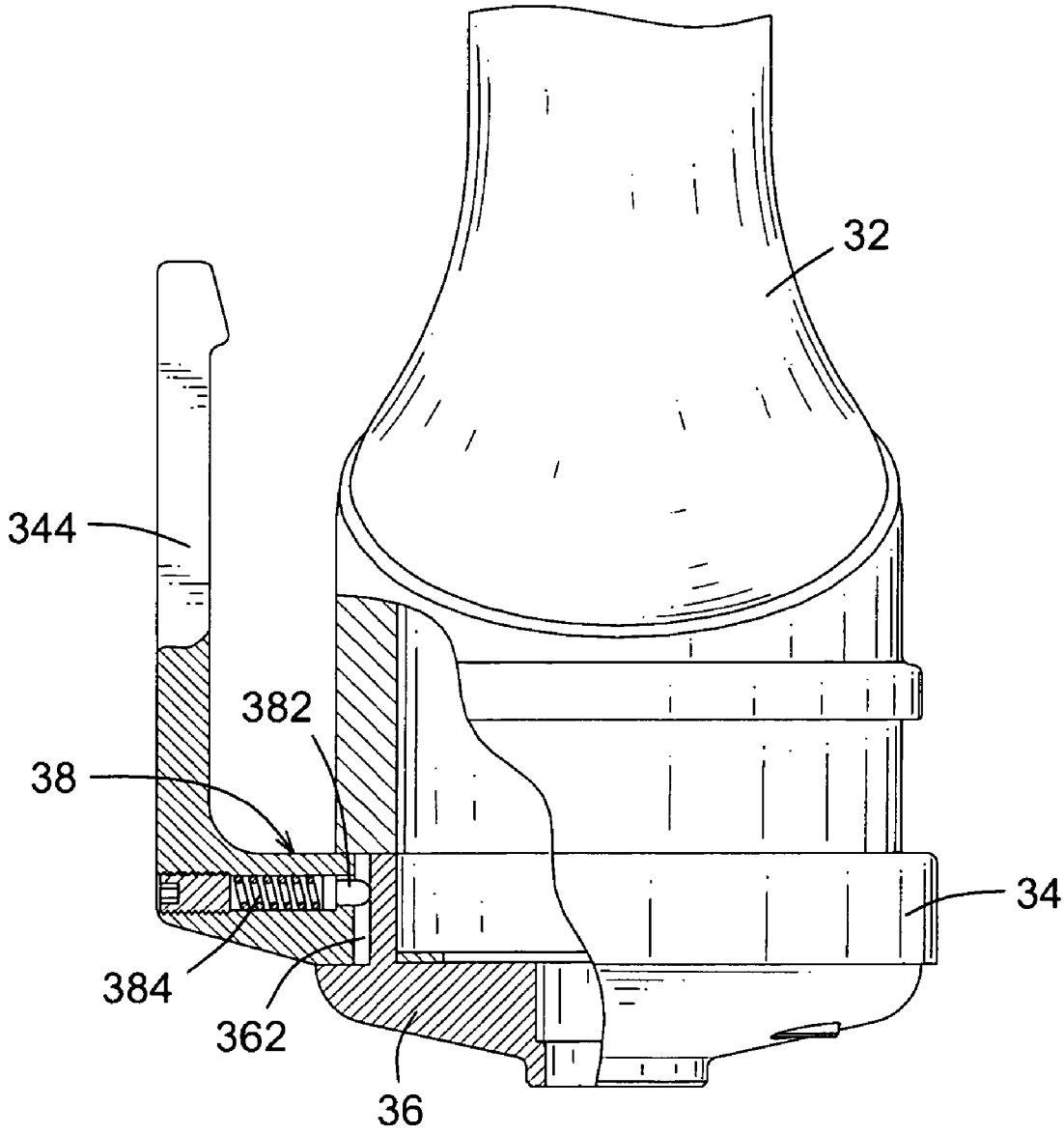
FIG. 7 PRIOR ART
FIG. 7 is a side view in partial section of the conventional pneumatic tool in FIG. 6.

When the user wants to change the position of the clip (14), with reference to FIGS. 4 and 5, the clip (14) is pushed to move along the shank (122) and to disengage the teeth (144) from the recesses (182) in the cap (18). Consequently, the clip (14) can be rotated relative to the shank (122) to change the position of the clip tab (148). When the clip (14) is rotated to another desired position, the force for pushing the clip (14) is released and the clip (14) will be pushed to move toward the cap (18) by the force provided by the biasing member (16). Accordingly, the teeth (144) will automatically reengage with the recesses (182) in the cap (18) to hold the clip (14) at the new position, such that the user can adjust the position of the clip (14) conveniently.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A pneumatic tool comprising:

a body;

a handle formed on and extending from the body and having a free end and an annular shank extending from the free end;

a clip rotatably and slidably mounted on the shank and comprising a collar rotatably and slidably mounted around the annular shank and having multiple teeth formed on a side of the collar facing away from the body; and a clip tab extending from the collar;

a biasing member mounted around the annular shank and having two ends abutting respectively with the handle and the collar;

a cap detachably attached to the shank and having multiple recesses respectively corresponding to and engaging with the teeth on the collar.

2. The pneumatic tool as claimed in claim 1, wherein the handle has a skirt formed around the free end of the handle and having an annular opening facing the collar;

the collar has an annular spring recess defined in a side facing the handle; and the ends of the biasing member are held respectively inside the skirt and the spring recess to abut respectively with the handle and the collar.

3. The pneumatic tool as claimed in claim 2, wherein the cap has multiple through holes defined through the cap;

the shank has multiple threaded holes in the shank, aligning respectively with the through holes in the cap; and multiple bolts extend through the through holes in the cap and screw into the threaded holes in the shank, respectively.

4. The pneumatic tool as claimed in claim 1, wherein the cap has multiple through holes defined through the cap;

the shank has multiple threaded holes in the shank, aligning respectively with the through holes in the cap; and multiple bolts extend through the through holes in the cap and screw into the threaded holes in the shank, respectively.

* * * * *